US010907380B2

(12) United States Patent
Pavlik

(10) Patent No.: US 10,907,380 B2
(45) Date of Patent: Feb. 2, 2021

(54) POSITIVE DUAL-LOCKING LATCH AND METHOD OF USE

(71) Applicant: Seann Pavlik, Fort Lauderdale, FL (US)

(72) Inventor: Seann Pavlik, Fort Lauderdale, FL (US)

( * ) Notice: Subject to any disclaimer, the term of this patent is extended or adjusted under 35 U.S.C. 154(b) by 661 days.

(21) Appl. No.: 15/726,352

(22) Filed: Oct. 5, 2017

(65) Prior Publication Data

US 2019/0106907 A1 Apr. 11, 2019

(51) Int. Cl.
*E05B 63/00* (2006.01)
*E05B 1/00* (2006.01)
(Continued)

(52) U.S. Cl.
CPC ..... *E05B 63/0004* (2013.01); *E05B 1/0007* (2013.01); *E05B 1/0038* (2013.01);
(Continued)

(58) Field of Classification Search
CPC ..... E05B 2015/0066; E05B 15/0053; E05B 63/0004; E05B 1/0007; E05B 1/0038;
(Continued)

(56) References Cited

U.S. PATENT DOCUMENTS 756,453 A * 4/1904 Arens et al. ..... E05B 63/20 292/163
3,057,649 A * 10/1962 Check ..... E05B 63/22 292/74
(Continued)

FOREIGN PATENT DOCUMENTS

DE 1784817 A1 * 1/1972 ..... E05C 19/165
DE 2709941 A1 * 9/1978 ..... E05C 1/16
(Continued)

OTHER PUBLICATIONS

International Search Report and Written Opinion from the International Search Authority dated Jan. 22, 2019 for PCT/US2018/054426.

*Primary Examiner* — Christine M Mills
(74) *Attorney, Agent, or Firm* — The Concept Law Group, PA; Scott D. Smiley; Scott M. Garrett

(57) ABSTRACT

A positive dual-locking latch for use in combination with a door and including a latch base; a handle assembly at least partially housed within and translatable relative to the latch base; and a latch assembly mechanically coupled to the handle assembly. The handle assembly includes a handle member at least partially housed within a housing member, with the handle assembly being biased by a handle spring in a direction away from the latch base. The latch assembly includes at least one latch spring and a latch member mechanically coupled to the at least one latch spring. The handle assembly and the latch assembly are operably configured to translate the positive dual-locking latch between a first locked configuration and a second locked configuration when the handle member receives a pushing force, and between the second locked configuration and an unlocked configuration when the handle member receives a pulling force.

20 Claims, 14 Drawing Sheets

(51) Int. Cl.
*E05B 61/00* (2006.01)
*E05B 65/46* (2017.01)
*E05B 5/00* (2006.01)
*E05B 5/02* (2006.01)

(52) U.S. Cl.
CPC ..... *E05B 5/003* (2013.01); *E05B 5/006* (2013.01); *E05B 61/00* (2013.01); *E05B 65/46* (2013.01); *E05B 63/0065* (2013.01)

(58) Field of Classification Search
CPC ..... E05B 5/003; E05B 5/006; E05B 61/00; E05B 65/46; E05B 63/0065; E05B 5/00; E05B 85/22; E05B 85/103; E05B 85/107; E05C 1/065; E05C 1/14; E05C 1/145; E05C 19/022; E05C 19/028; Y10S 292/31; Y10S 292/37; Y10S 292/04; Y10T 292/0969; Y10T 292/0878; Y10T 292/097; Y10T 292/0995; Y10T 292/0977; Y10T 292/1014; Y10T 292/57
USPC ..... 292/163, 74, 164, 174, 169, 138, 336.3, 292/DIG. 31, DIG. 37, DIG. 4
See application file for complete search history.

(56) References Cited

U.S. PATENT DOCUMENTS 3,659,444 A * 5/1972 Wellekens ..... E05B 17/04 70/360
4,616,861 A * 10/1986 Kurosaki ..... E05C 19/022 292/129
5,346,266 A * 9/1994 Bisbing ..... E05B 17/0025 292/142
5,746,456 A * 5/1998 Violi ..... E05C 19/022 292/146
6,113,160 A * 9/2000 Johansson ..... E05B 5/003 292/169
6,343,816 B1 * 2/2002 King ..... E05B 63/22 292/165
6,539,579 B2 * 4/2003 Minami ..... E05D 7/1011 16/229
6,575,503 B1 * 6/2003 Johansson ..... E05C 3/042 292/170
D537,317 S * 2/2007 Jackson, Jr. ..... D8/300
D546,661 S * 7/2007 Jackson, Jr. ..... D8/302
D549,075 S * 8/2007 Jackson, Jr. ..... D8/331
7,695,031 B2 * 4/2010 Jackson, Jr. ..... E05B 1/0038 292/169
D698,221 S * 1/2014 Condon ..... D8/300
8,733,815 B2 * 5/2014 Kwon ..... E05B 81/06 296/50
2001/0045114 A1 * 11/2001 Sokurenko ..... E05B 13/105 70/370
2005/0121544 A1 * 6/2005 Pavlik ..... B05B 15/74 239/570
2007/0069527 A1 * 3/2007 Rechberg ..... B60R 7/10 292/304
2007/0216169 A1 9/2007 Jackson, Jr. et al.
2015/0197969 A1 * 7/2015 Tung ..... E05B 1/0038 292/137
2019/0166970 A1 * 6/2019 Durksz ..... A45D 27/29

FOREIGN PATENT DOCUMENTS

DE 202013102641 U1 * 9/2014 ..... E05B 15/021
DE 102014222269 A1 * 5/2016 ..... E05B 81/18
EP 0821124 A2 * 1/1998 ..... E05B 63/22

* cited by examiner

100

POSITIVE DUAL-LOCKING LATCH AND METHOD OF USE

FIELD OF THE INVENTION

The present invention relates generally to latches, and, more particularly, relates to a positive dual-locking latch having enhanced safety features, such as a positive latch bias, requiring a pulling force to be exerted on the latch in order to disengage the latch from a door, thereby unlocking the door frame and allowing the door to be opened.

BACKGROUND OF THE INVENTION

The use of latches for closing cabinets, doors, drawers, and the like is well known. One problem that exists with known latches is that the locking components are often not designed to positively lock, or directly engage with, the cabinet in different positions, thereby causing the door to inadvertently open. Such inadvertent opening not only causes damage to the door but also poses a safety risk to a person in close proximity to the moving door. This can be especially hazardous on moving vehicles and vessels where rooms are relatively small. For example, a swinging door in a marine vessel is highly likely to strike a person due to the relatively small amount of occupancy space available.

Among other drawbacks, a number of known latches include a button, knob, or the like, that permanently protrudes outwardly from the cabinet or door which may easily become caught around a person's clothing, purse strap, or the like. Said another way, many known latches do not include a recessed knob that is flush with an outer surface of the cabinet and prevents the knob from being snagged by a passerby or otherwise damaged. Further, the known latches that include a recessed knob are locked only in the recessed position, becoming unlocked when protruding from the cabinet or door, thereby allowing the cabinet or door to inadvertently open.

Therefore, a need exists to overcome the problems with the prior art as discussed above.

SUMMARY OF THE INVENTION

The invention provides a positive dual-locking latch and a method of use that overcomes the herein-aforementioned disadvantages of the heretofore-known devices and methods of this general type, and that includes a first locked configuration, a second locked configuration, and an unlocked configuration. The positive dual-locking latch remains locked when it protrudes from an exterior surface of a door. As such, the positive dual-locking latch requires a pulling force to be exerted on it in order to disengage the latch member from the door, thereby unlocking the door and allowing the door to be opened.

With the foregoing and other objects in view, there is provided, in accordance with the invention, a positive dual-locking latch for use in combination with a door. The positive dual-locking latch includes a latch base defining a latch opening; a handle assembly at least partially housed within and translatable relative to the latch base; and a latch assembly mechanically coupled to the handle assembly. The handle assembly includes a proximal end having a housing member, the housing member defining a first portion of a slot-protrusion assembly; a handle pin mechanically coupled to the housing member; a handle spring mechanically coupled to the housing member; and a distal end opposite the proximal end, the distal end having a handle member. The handle member is at least partially housed within the housing member; is biased by the handle spring along a handle translation path in a direction away from the latch base; defines a first aperture sized and shaped to receive the handle pin in a first locked configuration; defines a second aperture sized and shaped to receive the handle pin in a second locked configuration; is disposed to translate the handle pin between the first aperture in the first locked configuration and the second aperture in the second locked configuration when moved toward the latch base; and is disposed to translate the handle assembly from the second locked configuration to an unlocked configuration to unlock the door when moved away from the latch base. The latch assembly includes at least one latch spring; a latch member mechanically coupled to the at least one latch spring; and a second portion of the slot-protrusion assembly sized and shaped to mechanically couple with the first portion of the slot-protrusion assembly.

In accordance with another feature, in one embodiment of the present invention, in the first locked configuration, the handle member is positioned substantially flush with an exterior surface of the door; the handle spring is compressed; and the handle pin is retained within the first aperture.

In accordance with a further feature, in one embodiment of the present invention, in the second locked configuration, the handle member protrudes to a first position in an ambient environment surrounding an exterior surface of the door revealing a user-accessible knob, the user-accessible knob being substantially flush with the exterior surface of the door in the first locked configuration; the handle spring is at least partially decompressed; and the handle pin is retained within the second aperture.

In accordance with yet another feature, in one embodiment of the present invention, in the unlocked configuration, the handle member extends to a second position in the ambient environment surrounding the exterior surface of the door, the second position being further from the exterior surface of the door as compared to the first position; and the housing member translates from a locked position to an unlocked position.

In accordance with another characteristic, in one embodiment of the present invention, the unlocked configuration includes the slot-protrusion assembly being translated from a locked position to an unlocked position; and as a result of the translation, at least one latch spring being compressed, so as to cause the latch m ember to translate from a locked position to an unlocked position.

In accordance with another feature, in one embodiment of the present invention, the handle member further includes a threaded portion and a user-accessible knob mechanically coupled to the threaded portion.

In accordance with a further feature, in one embodiment of the present invention, the handle spring is configured to compress and apply a biasing force on the handle member in a direction toward the distal end of the handle assembly; and the handle pin is disposed to lock the handle member in the first locked configuration or the second locked configuration against the biasing force of the handle spring, depending on which of the first and second aperture the handle pin is retained within.

In accordance with another characteristic, in one embodiment of the present invention, the latch spring is configured to compress and apply a biasing force on the latch member in a direction toward the distal end of the latch assembly to bias the latch member in a locked position.

In accordance with yet another feature, one embodiment of the present invention includes an arm member mechanically coupled to at least one latch spring, the arm member operably configured to exert a force from at least one latch spring to the latch member to bias the latch member in the locked position through an opening in the latch base.

Also in accordance with the invention, a positive dual-locking latch for use in combination with a door of a moving vehicle is disclosed, the positive dual-locking latch including a latch base defining a latch opening; a handle assembly at least partially housed within and translatable relative to the latch base; and a latch assembly mechanically coupled to the handle assembly. The handle assembly includes a proximal end having a housing member, the housing member defining a first slot and a second slot, the first and second slots being parallel to each other and on opposite sides of the housing member; a handle spring mechanically coupled to the housing member; and a distal end opposite the proximal end, the distal end having a handle member. The handle member is at least partially housed within the housing member; is biased by the handle spring in a direction away from the latch base; defines a first aperture corresponding to a first locked configuration; and defines a second aperture corresponding to a second locked configuration and an unlocked configuration, the second aperture positioned between the first aperture and the handle spring. The handle assembly also includes a push-pull actuator mechanically coupled to the handle member. The latch assembly includes a latch member biased by a latch spring in a direction away from the latch base; a first latch pin sized and shaped to be received by the first slot of the housing member; and a second latch pin sized and shaped to be received by the second slot of the housing member. The handle assembly is operably configured to actuate the opening and closing of the latch assembly.

In accordance with another feature, in one embodiment of the present invention, the push-pull actuator is operably configured to translate the handle assembly from the first locked configuration to the second locked configuration when moved toward the latch base, thereby extending the push-pull actuator to allow a user to grasp the push-pull actuator; and translate the handle assembly from the second locked configuration to the unlocked configuration when moved away from the latch base, thereby unlocking the door.

In accordance with a further feature, in one embodiment of the present invention, the push-pull actuator is a user-accessible knob.

In accordance with another characteristic, in one embodiment of the present invention, as a result of translating the handle assembly from the second locked configuration to the unlocked configuration, the unlocked configuration includes the first latch pin and the second latch pin translating from a locked position to an unlocked position, and the latch spring being compressed by the translation, so as to cause the latch member to translate from a locked position to an unlocked position.

In accordance with yet another feature, one embodiment of the present invention includes a handle pin mechanically coupled to the housing member, the handle pin operably configured to be received by the first aperture and the second aperture of the push-pull actuator.

In accordance with another characteristic, in one embodiment of the present invention, the handle pin is retained within the second aperture in the second locked configuration and the unlocked configuration.

In accordance with another feature, in one embodiment of the present invention, in the first locked configuration, the push-pull actuator is positioned substantially flush with an exterior surface of a door.

Also in accordance with the invention, a positive dual-locking latch for use in combination with a door is disclosed, the positive dual-locking latch including a latch assembly having a first locked configuration, a second locked configuration, and an unlocked configuration. The latch assembly includes a latch base operably configured to attach to an interior surface of a door, the latch base defining a substantially vertical plane along the interior surface of the door; a latch member biased by a latch spring in a direction that is away from and substantially parallel to the substantially vertical plane defined by the latch base, the latch member operably configured to engage with at least a portion of the door; a handle member biased by a handle spring in a direction that is away from and substantially perpendicular to the substantially vertical plane defined by the latch base, the handle member operably configured to disengage the latch member from the door; and a push-pull actuator mechanically coupled to the handle member. In the first locked configuration of the latch assembly, the push-pull actuator is substantially flush with an exterior surface of the door and the latch member is engaged with at least a portion of the door. In the second locked configuration of the latch assembly, the push-pull actuator is pushed toward the interior surface of the door and subsequently protrudes to a first position in an ambient environment surrounding the exterior surface of the door; and latch member is engaged with at least a portion of the door. In the unlocked configuration of the latch assembly, the push-pull actuator is pulled away from the exterior surface of the door to a second position in the ambient environment surrounding the exterior surface of the door, the second position being further from the exterior surface of the door as compared to the first position; and the latch member disengages from the door.

In accordance with another feature, in one embodiment of the present invention, the latch assembly is stationary in the first locked configuration and the second locked configuration.

In accordance with a further feature, in one embodiment of the present invention, the latch assembly is non-stationary in the unlocked configuration.

Although the invention is illustrated and described herein as embodied in an automatic door latch and a method of use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the handle member of the positive dual-locking latch.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
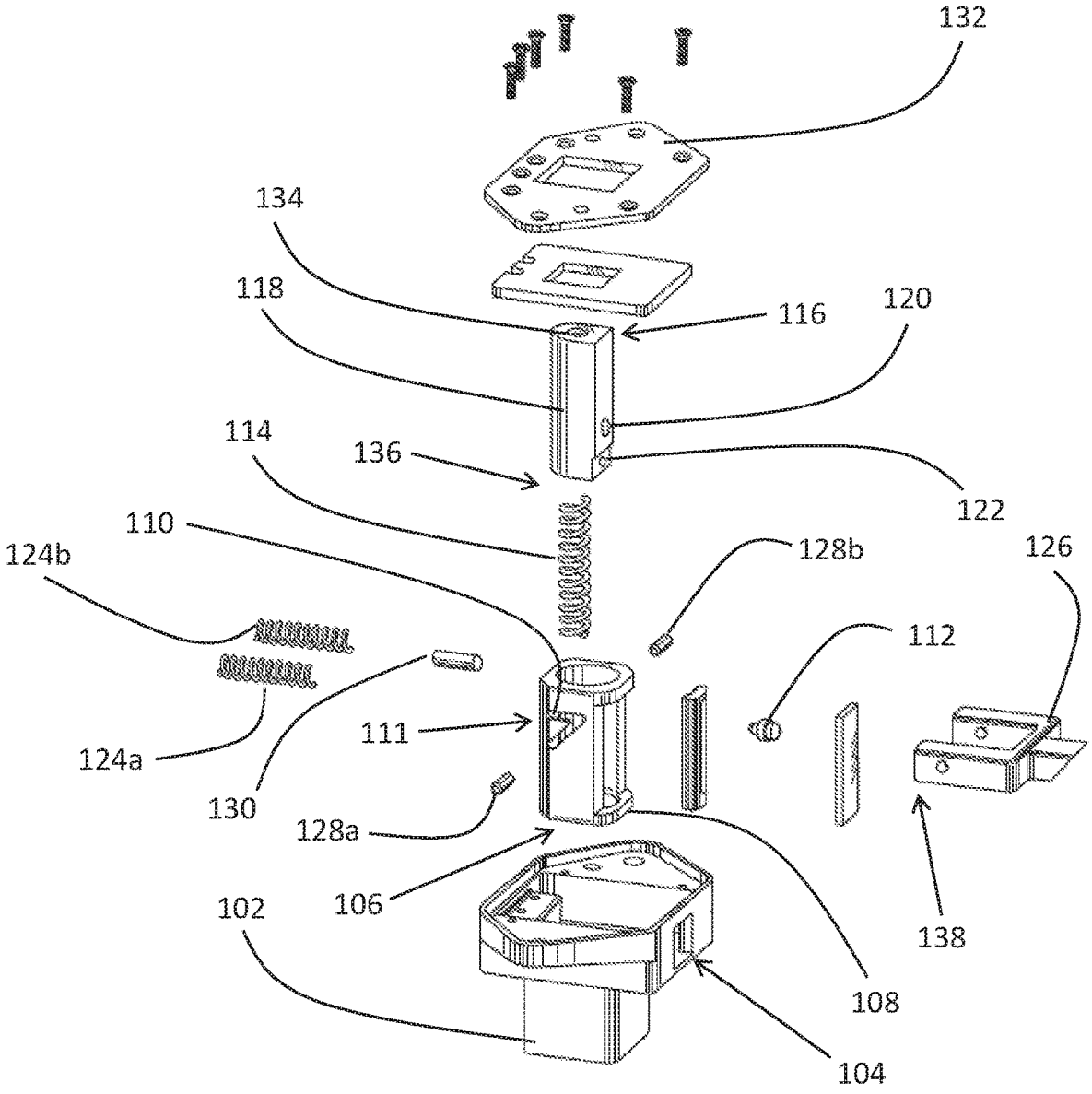
FIG. 1 is an exploded view of the internal components of a positive dual-locking latch, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient positive dual-locking latch configured to be used in combination with a door and a door frame or door strike, and including a first locked configuration, a second locked configuration, and an unlocked configuration. As used herein, "positive-dual locking latch" means a door latch that is positively engaged with a door frame, such that the door is locked in both a first locked configuration and a second locked configuration, and translated to an unlocked configuration only after receiving a force from a user. As used herein, "door" means a traditional hinged door, sliding door within a track, gate, hatch, portal, cabinet, drawer, lid, container, and any other barrier to an entrance or opening to a room or other type of compartment. For example, the door may be a cabinet on a moving vehicle, such as a recreational vehicle, airplane, train, or nautical vessel. In the first locked configuration, a latch member is positively engaged with at least a portion of a door frame, with a handle assembly being positioned substantially flush with an exterior surface of the door. In the second locked position, the latch member remains positively engaged with the at least a portion of the door frame and/or strike, with the handle assembly protruding from the exterior surface of the door. In the unlocked position, the latch member disengages from the door frame and/or strike when the handle assembly is pulled away from the protruding position, thereby unlocking the door and allowing the door to be opened. When the knob is released, and/or the door is closed, it returns to the first locked configuration.

Referring now to FIG. 1, one embodiment of the present invention is shown in an exploded view. FIG. 1 shows several advantageous features of the present invention, but, as will be described below, the invention can be provided in several shapes, sizes, combinations of features and components, and varying numbers and functions of the components. The first example of a positive dual-locking latch 100, as shown in FIG. 1, includes a latch base 102, a handle assembly 136, and a latch assembly 138.

As shown in FIG. 1, the positive dual-locking latch 100 may include a handle assembly 136 at least partially housed within and translatable relative to a latch base 102. As used herein, "handle assembly" shall mean an assembly of component parts directed to a user-accessible and user-actuated handle of the positive dual-locking latch 100. In one embodiment, the handle assembly 136 may include a proximal end 106 having a housing member 108, which may define a first portion of a slot-protrusion assembly 111. Through the first portion 110 of the slot-protrusion assembly 111, the handle assembly 136 may be translated to selectively lock and unlock a door. In one embodiment, and as shown in FIG. 1, the first portion 110 of the slot-protrusion assembly 111 may be at least one slot 110 operably configured and sized and shaped to receive a protrusion, such as a pin 128. For example, the first portion 110 of the slot-protrusion assembly 111 may be the at least one v-slot 110 shown in FIG. 1. In another embodiment, the first portion 110 of the slot-protrusion assembly 111 may be a protrusion, such as the pin 128, operably configured to be received by the slot 110. In a preferred embodiment, the first portion 110 of the slot-protrusion assembly 111 may be a first slot 110*a* and a second slot 110*b*, the first and second slots 110*a*, 110*b* being parallel to each other and on opposite sides of the housing member 108. In other embodiments, the protrusion 128 may extend from the housing member 108 and may be operably configured to couple with other components of the slot-protrusion assembly 111, such as slots on defined by components of the latch assembly 138, described in greater detail below.

In one embodiment, the handle assembly 136 may include a distal end 116 opposite the proximal end 106, the distal end 116 having a handle member 118. In one embodiment, the handle member 118 may be at least partially housed within the housing member 108. In one embodiment, the handle member 118 may include a threaded portion 134, which may be operably configured to mechanically couple with a user-accessible knob 206 (as shown in FIGS. 2-6), such as by screwing the user-accessible knob 206 into the handle member 118 via the threaded portion 134. As used herein, "user-accessible knob" means a knob that may be grasped, grabbed, gripped, or otherwise interacted with by a user. In one embodiment, the handle member 118 may be biased by a handle spring 114 along a handle translation path in a direction away from the latch base 102, with the handle spring 114 being at least partially housed within the housing member 108. Said another way, the handle spring 114 may be configured to compress and apply a biasing force on the handle member 118 in a direction rd the distal end 116 of the handle assembly.

Figure 2:
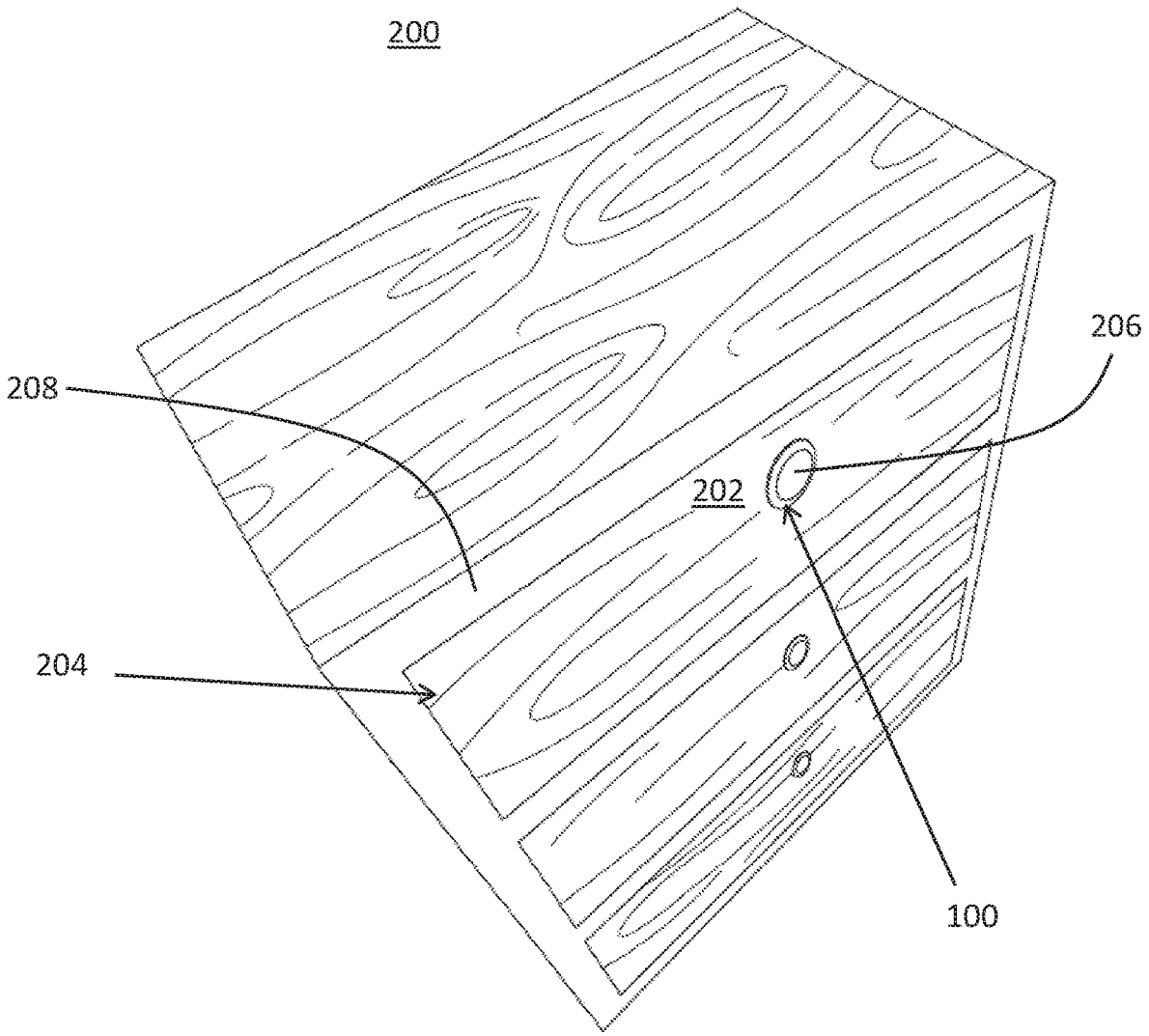
FIG. 2 is a perspective exterior view of the positive dual-locking latch of FIG. 1 in a first locked configuration, in accordance with the present invention.
Figure 3:
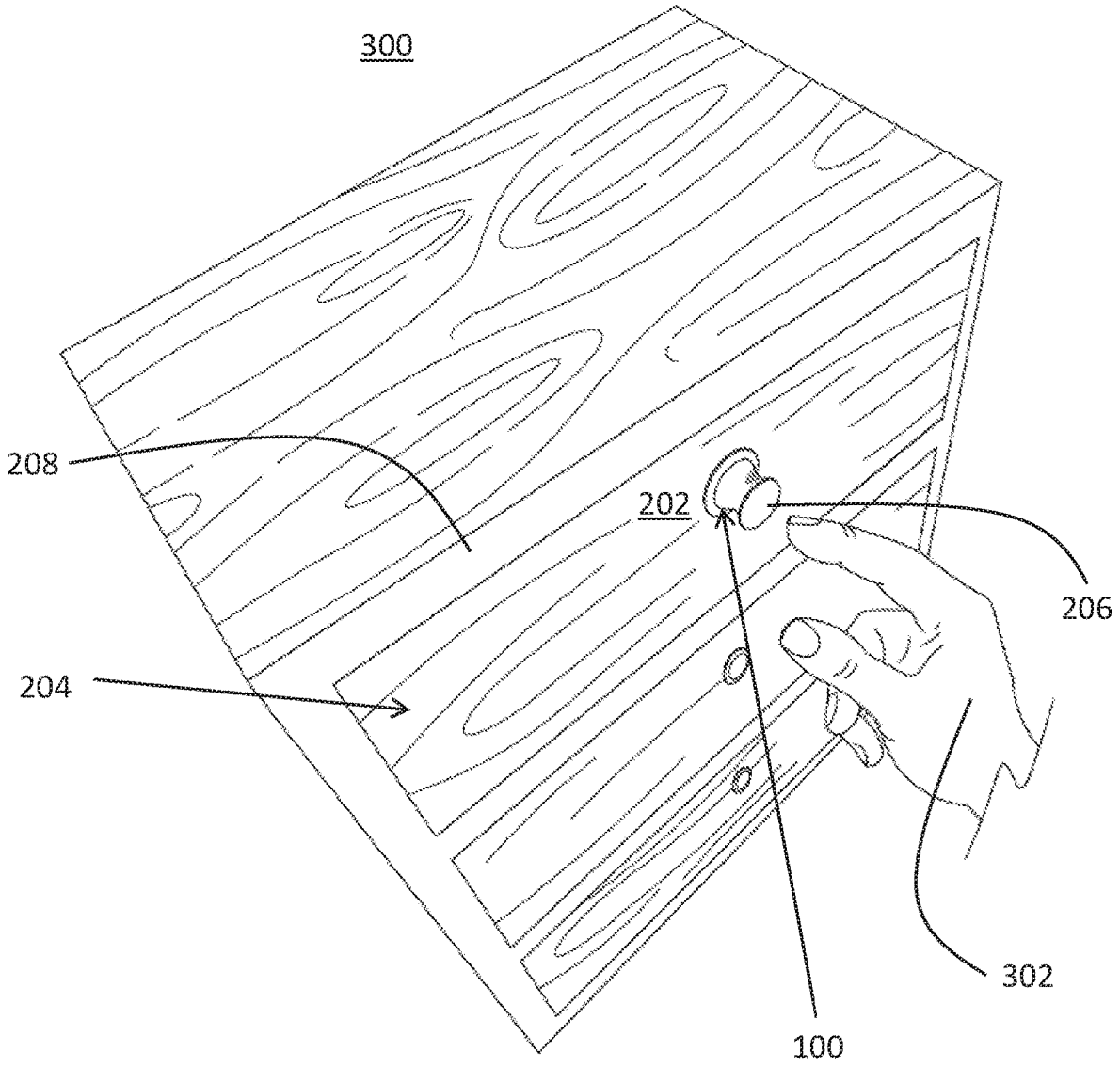
FIG. 3 is a perspective exterior view of the positive dual-locking latch of FIG. 1 in a second locked configuration, in accordance with the present invention.
Figure 6:
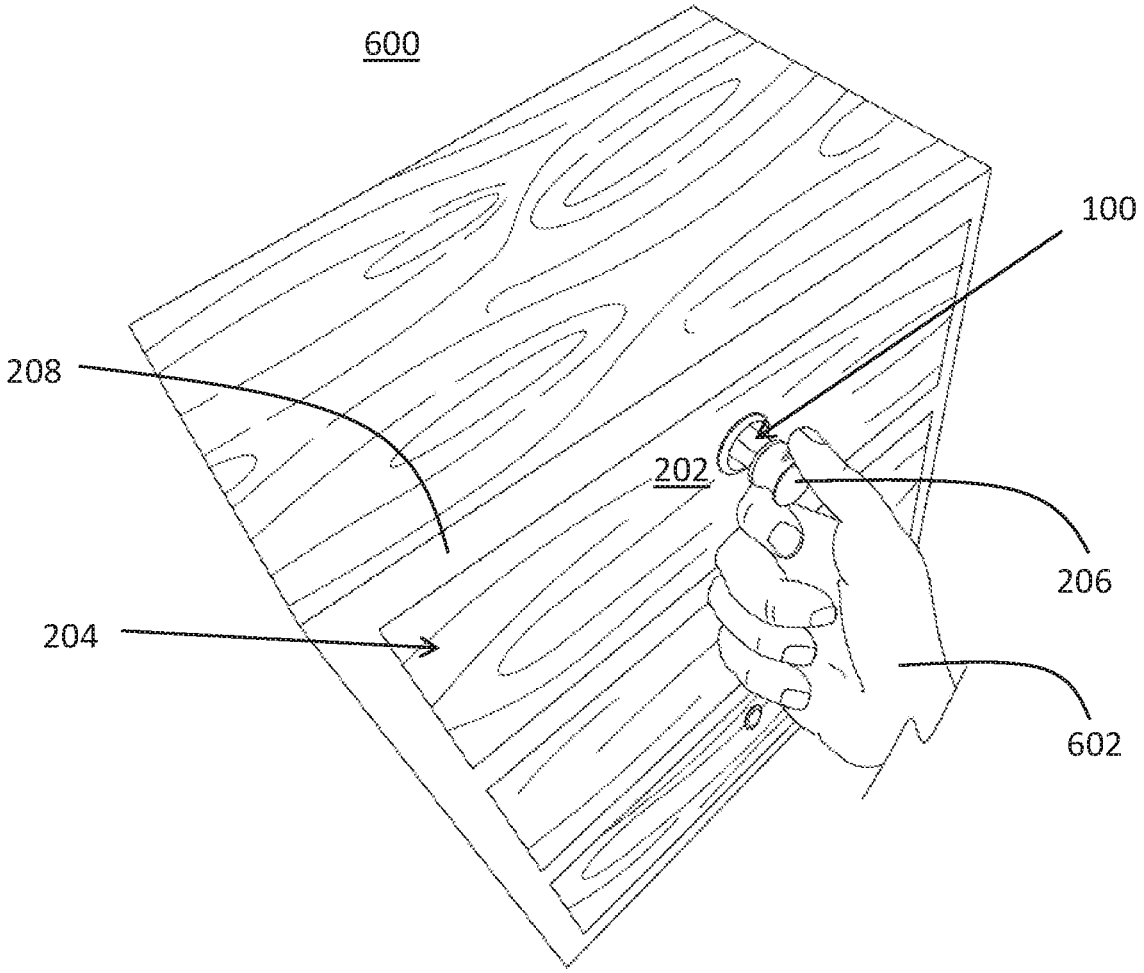
FIG. 6 is a perspective exterior view of the positive dual-locking latch of FIG. 1 in the unlocked configuration, where the handle member is pulled and extended away from the door, in accordance with the present invention.

In one embodiment, the handle member 118 may define a first aperture 120 and a second aperture 122, both of which may be sized and shaped to receive a handle pin 112 that may be mechanically coupled to the housing member 108. The first aperture 120 and the second aperture 122 may correspond to varying configurations of the handle member 118. For example, when the handle pin 112 is retained within the first aperture 120, the handle member 118 may be in a first locked configuration 200 (as shown in FIG. 2). When the handle pin 112 is retained within the second aperture 122, the handle member 118 may be in a second locked configuration 300 (as shown in FIG. 3) or an unlocked configuration 600 (as shown in FIG. 6).

Figure 5:
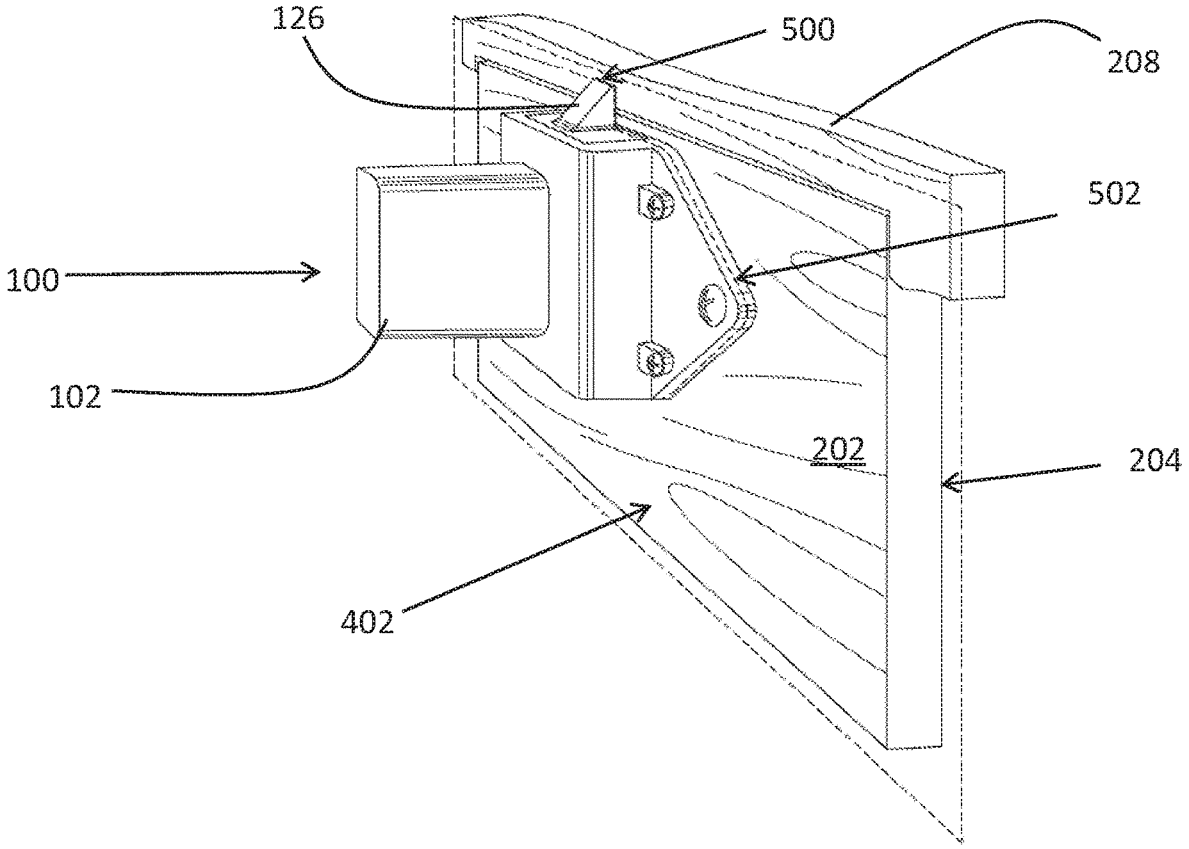
FIG. 5 is an elevational interior view of the positive dual-locking latch of FIG. 1 in either the first locked configuration or the second locked configuration, where the latch member is extended in order to contact at least a portion of a door frame, in accordance with the present invention.

Still referring to FIG. 1, with a brief reference to FIG. 5, in one embodiment, the positive dual-locking latch 100 may include a latch assembly 138 mechanically coupled to the handle assembly 136. As used here, "latch assembly" shall mean an assembly of component parts directed to a user-actuated latch of the positive dual-locking, latch 100. In one embodiment, the latch assembly 138 may include at least one latch spring 124, with an exemplary embodiment including a first latch spring 124*a* and a second latch spring 124*b*, as shown in FIG. 1. In one embodiment, the latch assembly 138 may include a latch member 126 mechanically coupled to the at least one latch spring 124. The latch member 126 may be sized and shaped to protrude from the latch base 102 through a latch opening 104 defined by the latch base 102. In one embodiment, the at least one latch spring 124 may be operably configured to compress and apply a biasing force on the latch member 126 in a direction toward a distal end of the latch assembly 138, away from the latch base 102 and through the latch opening 104, to bias the latch member 126 in a locked position 500 (as shown in FIG. 5). In one embodiment, the latch assembly 138 may also include at least one arm member 130 coupled to the at least one latch spring 124, with the at least one arm member 130 operably configured to exert a force from the at least one latch spring 124 to the latch member 126 to bias the latch member 126 in a direction away from the latch base 102 and through the latch opening 104, in the locked position 500 (as shown in FIG. 5).

Figure 8:
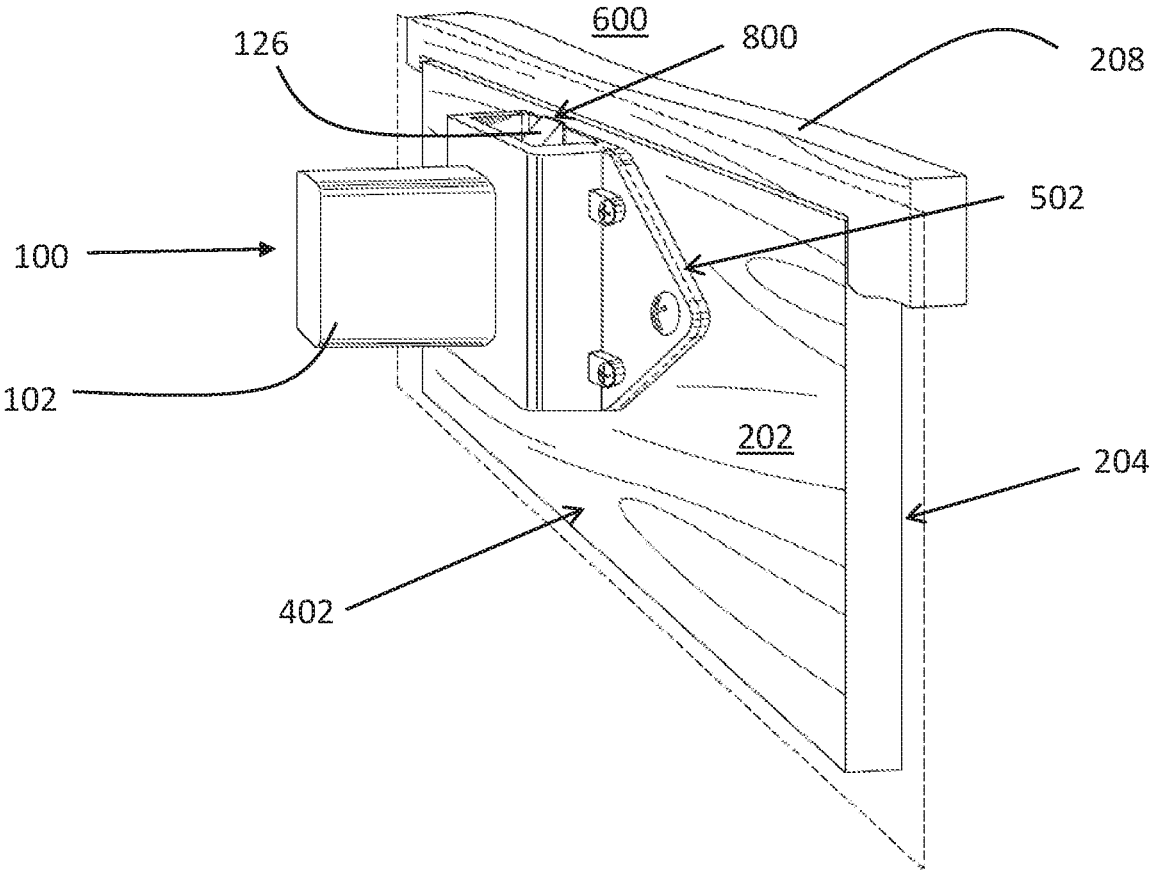
FIG. 8 is an elevational interior view of the positive dual-locking latch of FIG. 1 in the unlocked configuration, where the latch member is depressed, allowing the door to be opened, in accordance with the present invention.

Referring still to FIG. 1, with brief reference to FIGS. 5 and 8, in one embodiment, the latch assembly may include a second portion 128 of the slot-protrusion assembly 111 that is sized and shaped to mechanically couple with the first portion 110 of the slot-protrusion assembly 111. In one embodiment, and as shown in FIG. 1, the second portion 128 of the slot-protrusion assembly 111 may be at least one protrusion 128, such as a pin 128, operably configured to be received by the first portion 110 of the slot-protrusion assembly 111, which may be a slot 110. For example, the second portion 128 of the slot-protrusion assembly 111 may include a first latch pin 128*a* and a second latch pin 128*b*, as shown in FIG. 1, that are operably configured and sized and shaped to be received by the first portion 110 of the slot-protrusion assembly 111, which may be comprised of a first slot 110*a* and a second slot 110*b*, the first and second slots 110*a*, 110*b* being parallel to each other and on opposite sides of the housing member 108. In another embodiment, the second portion 128 of the slot-protrusion assembly 111 may be a slot operably configured to receive a protrusion, such as a pin. In other embodiments, the latch assembly 138 may define at least one slot 110 which may be operably configured to receive at least one protrusion 128. The first and second portions 110, 128 of the slot-protrusion assembly 111 may operate to translate the latch member 126 from the locked position 500 (as shown in FIG. 5) to an unlocked position 800 (as shown in FIG. 8).

Referring now to FIG. 2, in one embodiment, the positive dual-locking latch 100 may include the first locked configuration 200. In the first locked configuration 200, the user-accessible knob 206 may be positioned substantially flush with an exterior surface 204 of a door 202. As used herein, "substantially flush" means a substantially even, level, coplanar, continuous, or tapered relationship between two surfaces, such that neither surface protrudes more than about 1 inch from the other surface. As such, in the first locked configuration 200, the door 202 remains locked and unopened, and the user-accessible knob 206 does not protrude from the exterior surface 204 of the door 202, such that a user would not inadvertently snag the user-accessible knob 206 when standing next to or moving past the door 202. Said another way, the door 202 is positioned flush with, retained by, and locked against at least a portion of a door frame 208. As used herein, "door frame" means any structure immediately adjacent a door against which a latch may be held in place, causing the door to be locked, such as the top of a desk, the sill or base of a door, a portion of an adjacent drawer, and the like. In one embodiment, in the first locked configuration 200, the handle spring 114 may be compressed, and the handle pin 112 may be retained within the first aperture 120.

Figure 4:
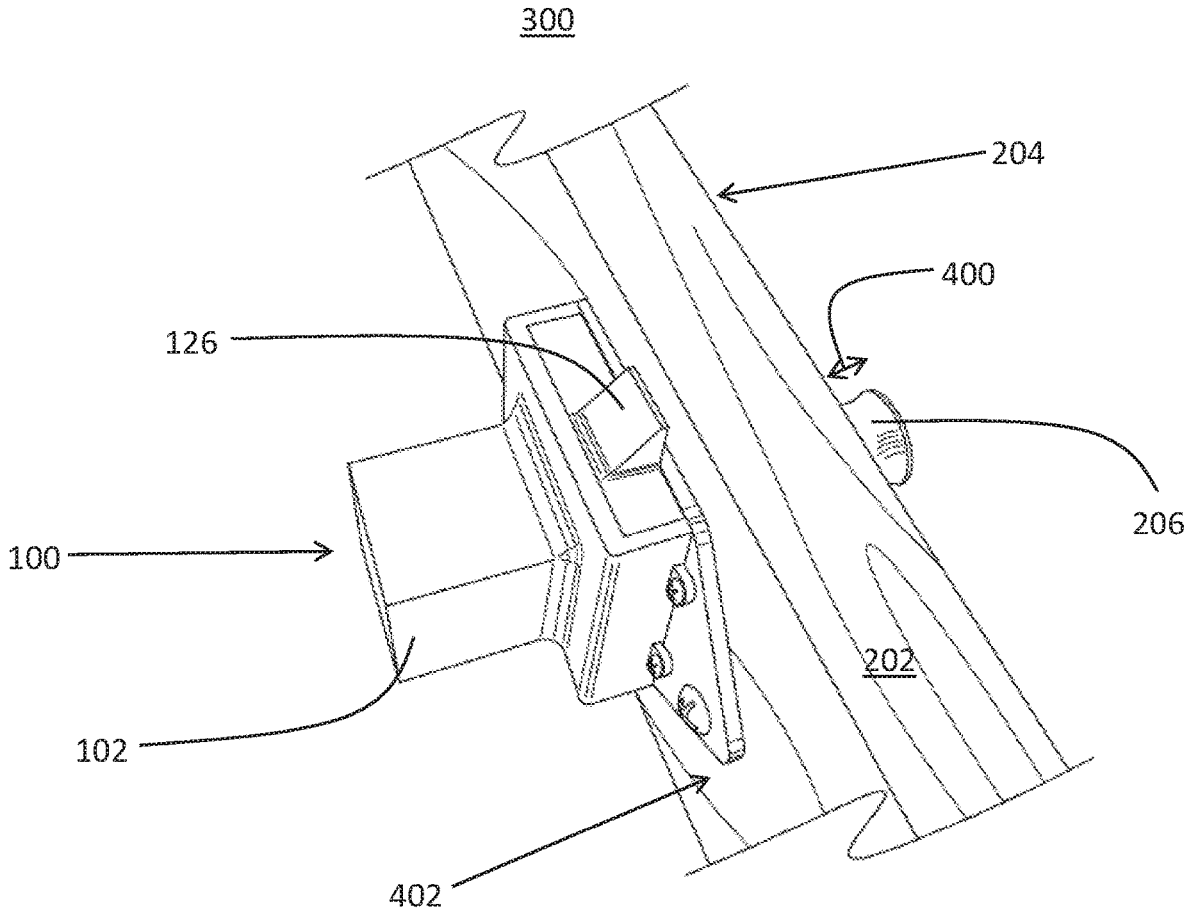
FIG. 4 is a perspective exterior view of the positive dual-locking latch of FIG. 1 in the second locked configuration, where the latch is member extended in order to contact at least a portion of a door frame, in accordance with the present invention.

Referring now to FIGS. 3-4, in one embodiment, the positive dual-locking latch 100 may include a second locked configuration 300. In the second locked configuration 300, the user-accessible knob 206 protrudes to a first position 400 in an ambient environment surrounding the exterior surface 204 of the door 202. When the user-accessible knob 206 protrudes to the first position 400 in the ambient environment surrounding the exterior surface 204 of the door 202, a user is able to grasp the user-accessible knob 206. In one embodiment, the user-accessible knob 206 may translate from the first locked configuration 200 to the second locked configuration 300 by receiving a pushing force 302 from a user. Said another way, a user may push the user-accessible knob 206 and the handle member 118 toward the latch base 102 and an interior surface 402 of the door 202, thereby compressing the handle spring 114 and subsequently causing the user-accessible knob 206 to protrude to the first position 400 in the ambient environment surrounding the exterior surface 204 of the door 202. In the second locked configuration 300, the door 202 remains locked and unopened. Said another way, the door 202 the door 202 remains positioned flush with, retained by, and locked against the at least a portion of the door frame 208.

In one embodiment, in the second locked configuration 300, the handle spring 114 may be at least partially decompressed, and the handle pin 112 may be retained within the second aperture 122. As such, when the user-accessible knob 206 receives the pushing force 302 from the user, the handle pin 112 may translate from the first aperture 120 to the second aperture 122, and remain retained within the second aperture 122 when the user-accessible knob 206 protrudes to the first position 400 in the ambient environment surrounding the exterior surface 204 of the door 202.

Referring now to FIG. 5, the positive dual-locking latch 100 is shown in greater detail, with the positive dual-locking latch 100 depicted as installed on a door 202. In one embodiment, the latch base 102 is operably configured to attach to the interior surface 402 of the door 202, such as by being mechanically coupled to the door 202 through screws or adhesives. In one embodiment, the latch base 102 may define a substantially vertical plane 502 along the interior surface 402 of the door 202. As used herein, "substantially vertical plane" means a plane that is coplanar with the plane defined by the interior surface 402 of the door 202, plus or minus 10°. In both the first and the second locked configurations 200, 300, the latch member 126 may be biased by the at least one latch spring 124 in a direction that is away from and substantially parallel to the substantially vertical plane 502 defined by the latch base 102. Similarly, in one embodiment, the handle member 118, and, thus, the user-accessible knob 206, may be biased by the handle spring 114 in a direction that is away from and substantially perpendicular to the substantially vertical plane 502 defined by the latch base 102.

Still referring to FIG. 5, in one embodiment, in both the first locked configuration 200 and the second locked configuration 300, the latch member 126 extends from the door 202 and may be operably configured to engage with at the at least a portion of the door frame 208, such that the latch member 126 is in a locked position 500. As such, when the latch member 126 is engaged with the at least a portion of the door frame 208, the door 202 is unable to be opened without a user further interacting with the positive dual-locking latch 100. It is also contemplated that the dual-locking latch can return to the first clocked configuration upon the knob 206 being released, or the door being closed.

Figure 7:
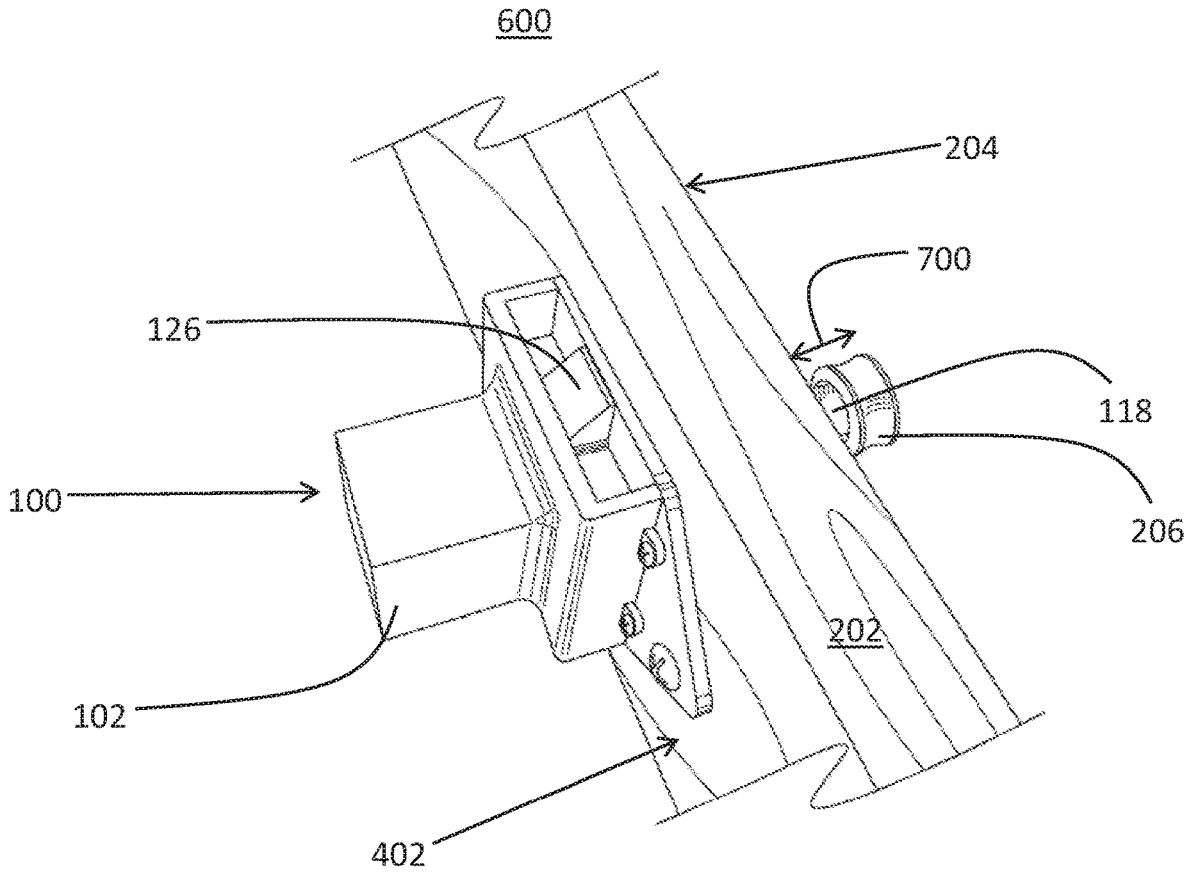
FIG. 7 is a perspective interior view of the positive dual-locking latch of FIG. 1 in the unlocked configuration, where the latch member is depressed, allowing the door to be opened, in accordance with the present invention.

Referring now to FIGS. 6-7, in one embodiment, the positive dual-locking latch 100 may include an unlocked configuration 600. In the unlocked configuration 600, the user-accessible knob 206 may extend to a second position 700 (as shown in FIG. 7) in an ambient environment surrounding the exterior surface 204 of the door 202. In one embodiment, the second position 700 is further from the exterior surface 204 of the door 202 as compared to the first position 400. In one embodiment, the user-accessible knob 206 and the handle member 118 translate from the second locked configuration 300 to the unlocked configuration 600 by receiving a pulling force 602 from a user. Said another way, a user may pull the user-accessible knob 206, and thus the handle member 118, away from the latch base 102 and the exterior surface 204 of the door 202, thereby causing the user-accessible knob 206 to protrude to the second position 700. Since the user-accessible knob 206 may be both pushed toward the latch base 102 and pulled away from the latch base 102, the user-accessible knob 206 may be referred to as a "push-pull actuator." In one embodiment, the user-accessible knob 206, the handle member 118, and the housing member 108 translate in a direction away from the latch base 102 when the positive dual-locking latch 100 translates from the second locked configuration 300 to the unlocked configuration 600.

Still referring to FIG. 8, in one embodiment, when the user-accessible knob 206, and thus the handle member 118, is pulled away from the exterior surface 204 of the door 202, the latch member 126 is translated from the locked position 500 (as shown in FIG. 5) to an unlocked position 800. Said another way, the handle assembly 136 may be operably configured to actuate the opening and closing of the latch assembly 138. As such, when the latch member 126 is in the unlocked position 800, the positive dual-locking latch 100 is in the unlocked configuration 600 (as shown in FIG. 6), thereby allowing the door 202 to be opened, because the latch member 126 is no longer engaged with or retained by the door frame 208. In a preferred embodiment, when a user releases the user-accessible knob 206, the user-accessible knob 206 and the handle member 118 return to the first position 400 (as shown in FIG. 4), and the latch member 126 returns to the locked position 500 (as shown in FIG. 5). In a preferred embodiment, the latch member 126 translates from the locked position 500 to the unlocked position 800 only when the user-accessible knob 206 is pulled away from the exterior surface 204 of the door 202. Said another way, the latch assembly may be stationary in the first locked configuration 200 and the second locked configuration 300, and the latch assembly may be non-stationary in the unlocked configuration 600.

Figure 9:
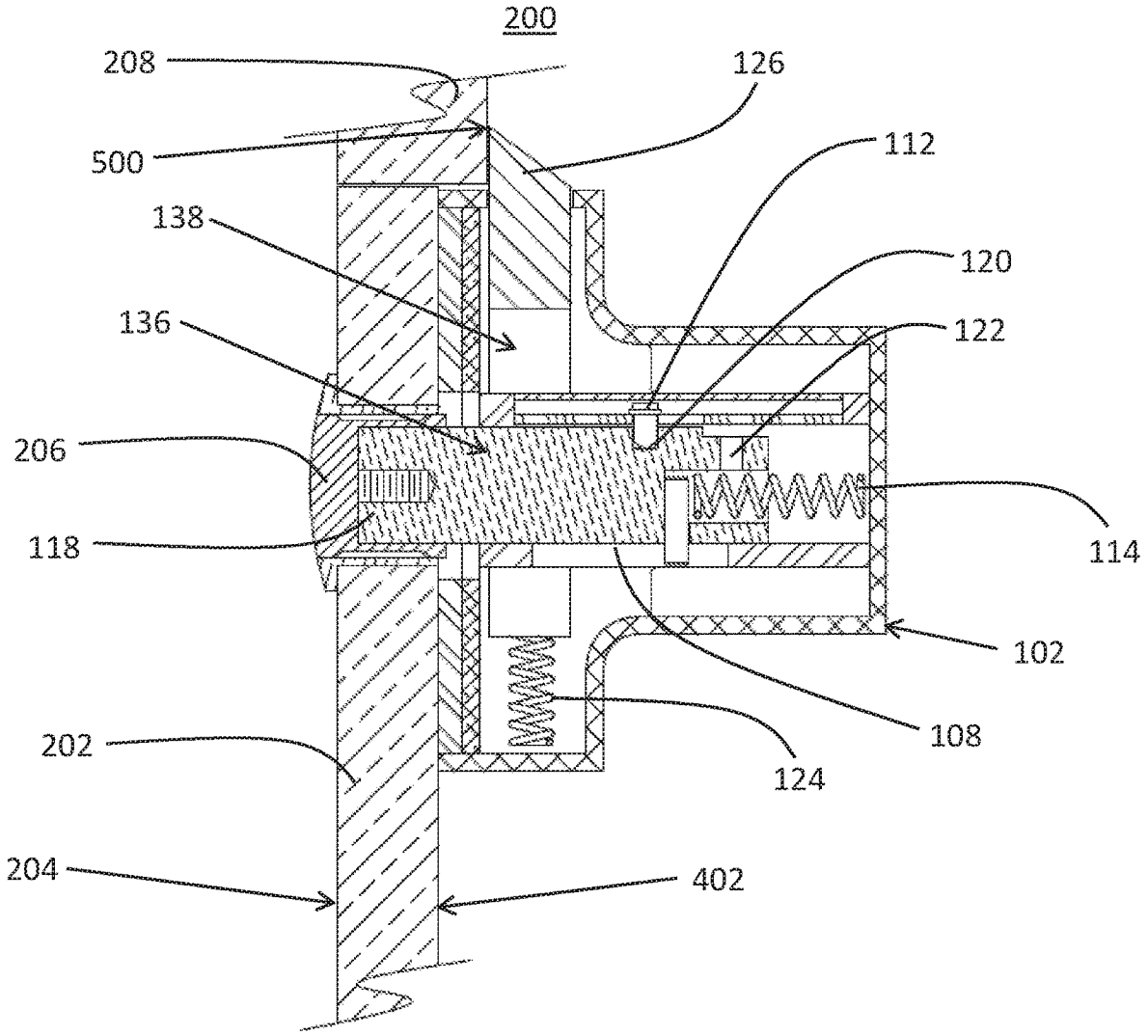
FIG. 9 is an elevational cross-sectional right-side view of the positive dual-locking latch of FIG. 1 in the first locked configuration, in accordance with the present invention.

Referring now to FIG. 9, the internal mechanism for translating the handle assembly 136 is depicted in detail. In one embodiment, the relationship between the handle pin 112 and the first aperture 120 may correspond to the first locked configuration 200 (also shown in FIG. 2). Said another way, when the handle pin 112 is retained by the first aperture 120, the positive dual-locking latch 100 may be in the first locked configuration 200. In one embodiment, the handle pin 112 may be disposed within the first aperture 120 to lock the handle member 118 against the biasing force of the handle spring 114 in the first locked configuration 200. In one embodiment, the user-accessible knob 206 may be substantially flush with the exterior surface 204 of the door 202 in the first locked configuration 200.

Figure 10:
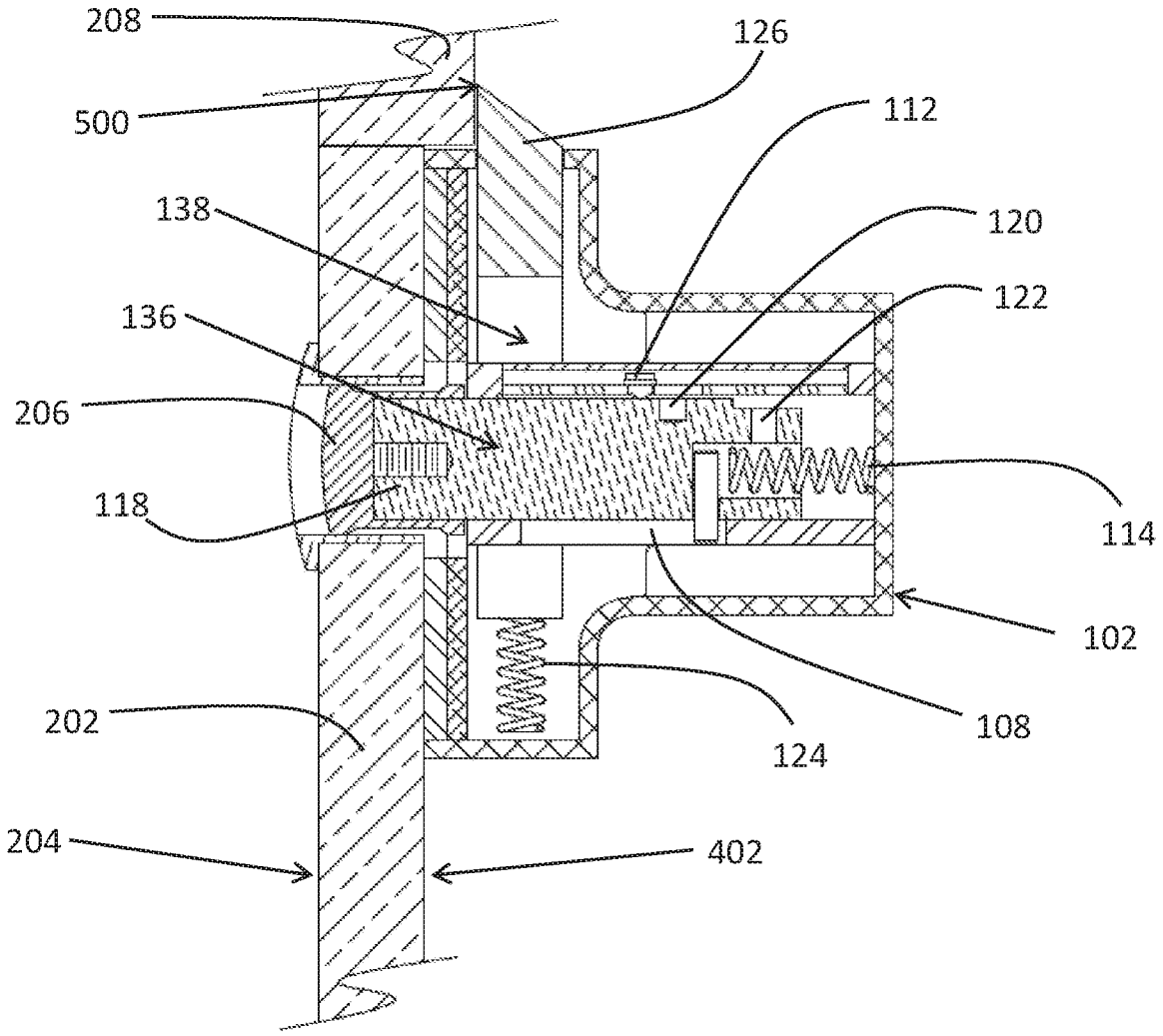
FIG. 10 is an elevational cross-sectional right-side view of the positive dual-locking latch of FIG. 1 after receiving a pushing force on the handle, with the handle spring partially compressed, in accordance with the present invention.

Referring now to FIG. 10, the handle assembly 136 is depicted in between the first locked configuration 200 and the second locked configuration 300. When the user-accessible knob 206 and the handle member are moved within the housing member 108 toward the latch base 102, such as by receiving a pushing force from a user, the handle pin 112 disconnects from the first aperture 120, as the handle spring 114 is compressed and the handle member 118 is translated away from the door 202 toward the latch base 102.

Figure 11:
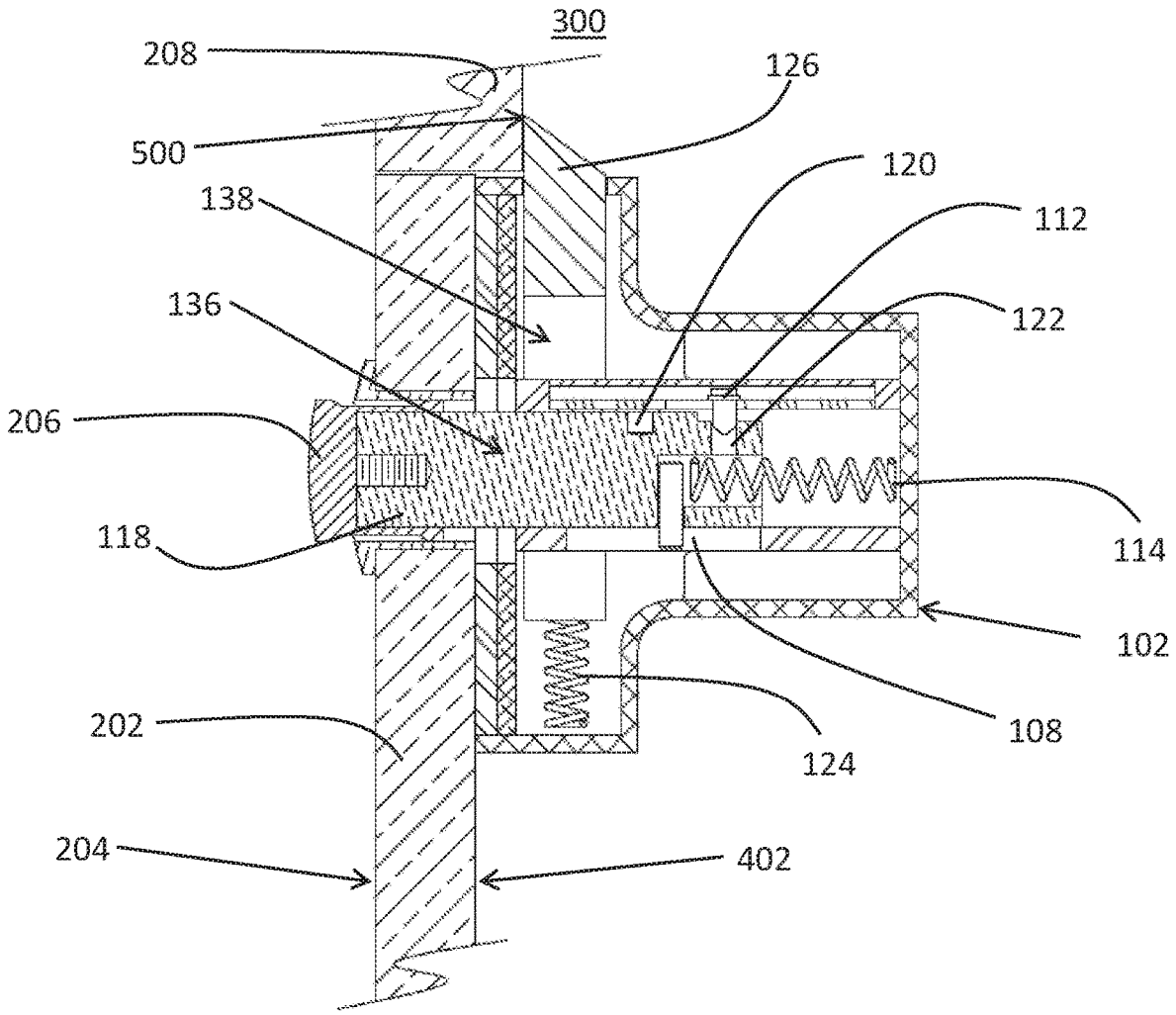
FIG. 11 is a elevational cross-sectional right-side view of the positive dual-locking latch of FIG. 1 in the second locked configuration accordance with the present invention.

Referring now to FIG. 11, the handle assembly 136 is depicted in the second locked configuration 300 (also shown in FIG. 3). In one embodiment, the relationship between the handle pin 112 and the second aperture 122 may correspond to the second locked configuration 300. Said another way, when the handle pin 112 is retained by the second aperture 122, the positive dual-locked latch 100 may be in the second locked configuration 300. In one embodiment, the handle pin 112 may be disposed within the second aperture 122 to lock the handle member 118 against the biasing force of the handle spring 114 in the second locked configuration 300. In one embodiment, the user-accessible knob 206 may extend away from the exterior surface 204 of the door 202 in the second locked configuration 300.

Figure 12:
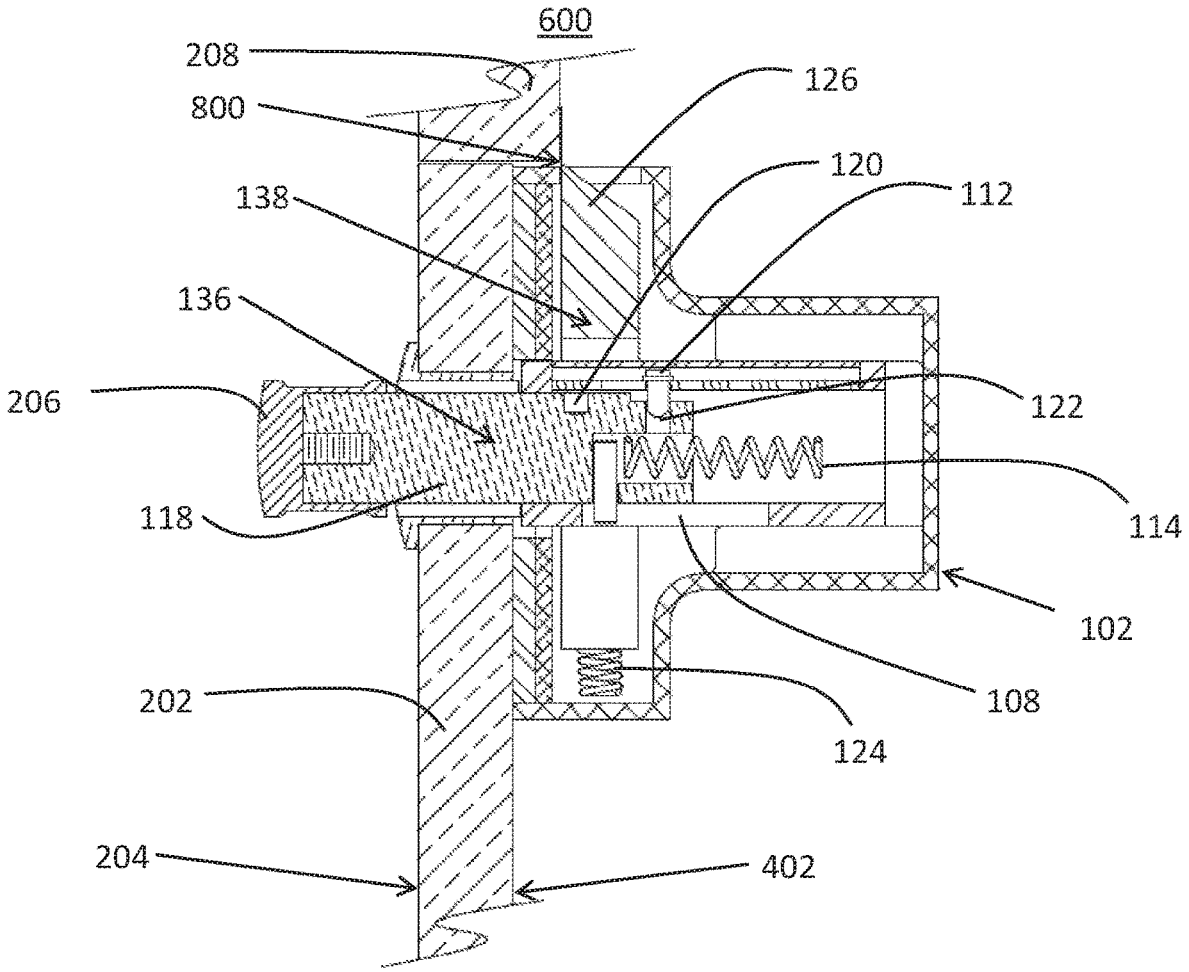
FIG. 12 is an elevational cross-sectional right-side view of the positive dual-locking latch of FIG. 1 in the unlocked configuration, in accordance with the present invention.

Referring now to FIG. 12, in one embodiment, when the user-accessible knob 206 is moved away from the latch base 102, such as by receiving a pulling force from a user, the handle member 118 may be disposed to translate the handle assembly 136 from the second locked configuration 300 to an unlocked configuration 600 (shown in FIG. 6). In the unlocked configuration 600, the handle pin 112 may remain within the second aperture 122. In one embodiment, when the positive dual-locking latch 100 is translated from the second locked configuration 300 to the unlocked configuration 600, the handle assembly 136, including the user-accessible knob 206, the handle member 118, the housing member 108, the handle pin 112, and the handle spring 114, translates together as a singular unit. In another embodiment, only the user-accessible knob 206 may translate to the second position 700 in the ambient environment surrounding the exterior surface 204 of the door 202 (as shown in FIG. 7). In one embodiment, when the handle assembly 136 is translated from the second locked configuration 300 to the unlocked configuration 600, the latch member 126 is translated from the locked position 500 to the unlocked position 800. The interaction between the handle assembly 136 and the latch assembly 138 is described in greater detail below.

Figure 13:
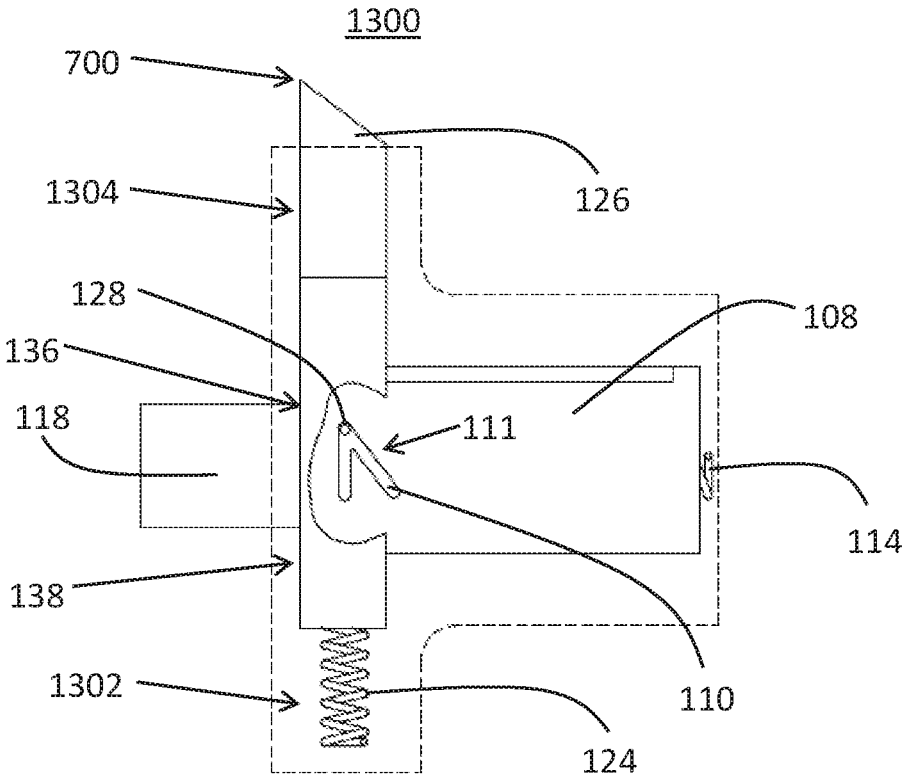
FIG. 13 is an elevational cross-sectional right-side view of the positive dual-locking latch of FIG. 1, where the latch assembly is in a locked position and the slot-protrusion assembly is in a first position, in accordance with the present invention.
Figure 14:
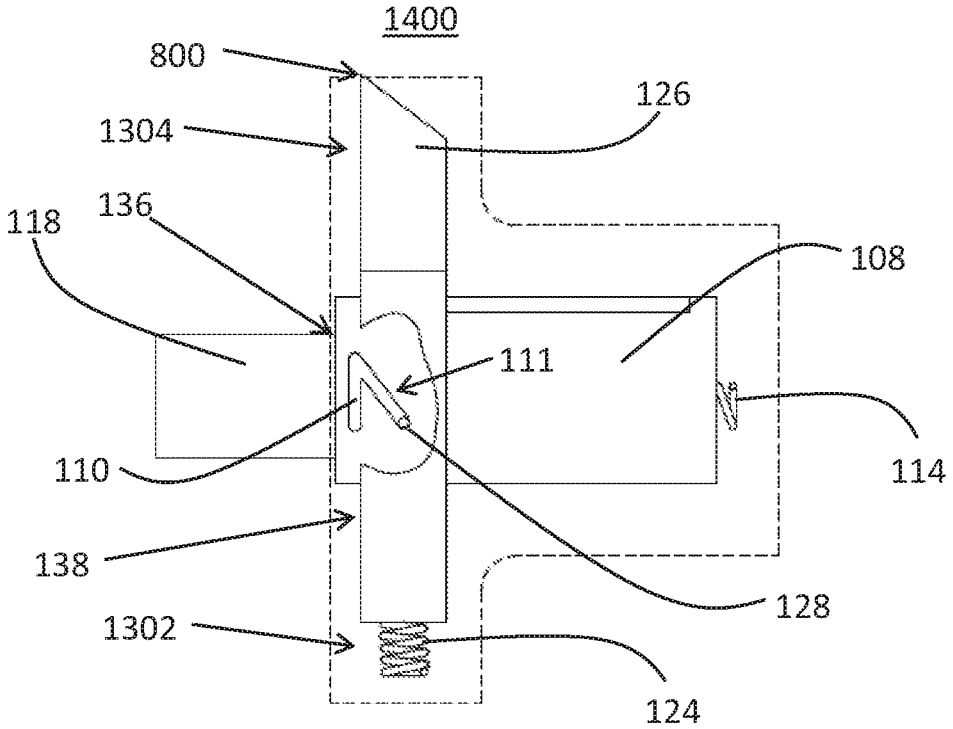
FIG. 14 is an elevational cross-sectional right-side view of the positive dual-locking latch of FIG. 1, where the latch assembly is in an unlocked position and the slot-protrusion assembly is in a second position, in accordance with the present invention.

Referring now to FIGS. 13-14, the internal mechanism for translating the latch assembly 138 is depicted in detail. In one embodiment, the first portion 110 of the slot-protrusion assembly 111 and the second portion 128 of the slot-protrusion assembly 111 are operably configured to translate from a locked position 1300 to an unlocked position 1400. For example, when the first portion 110 of the slot-protrusion assembly 111 is at least one slot, such as at least one v-slot, and when the second portion 128 of the slot-protrusion assembly 111 is at least one protrusion, such as at least one pin, the at least one pin may slide down the at least one v-slot from the locked position 1300 to the unlocked position 1400. As such, since the at least one pin is coupled to and retained by the at least one v-slot, the at least one v-slot prevents the at least one pin from decoupling from the slot-protrusion assembly 111. In an exemplary embodiment, the second portion 128 of the slot-protrusion assembly 111 is operably configured to translate along a vertical plane defined by the latch assembly 138. Said another way, the second portion 128 of the slot-protrusion assembly 111 may translate from a direction away from a distal end 1304 of the latch assembly 138, where the latch member 126 is located, to a direction toward a proximal end 1302 of the latch assembly 138, where the at least one latch spring 124 is located, when the positive dual-locking latch 100 is unlocked. As such, when the handle assembly 136 is translated from the second locked configuration 300 (as shown in FIG. 3) to the unlocked configuration 600 (as shown in FIG. 6), the first portion 110 of the slot-protrusion assembly 111, as a part of the housing member 108, may translate with the handle assembly 136 away from the latch base 102, thereby forcing the second portion 128 of the slot-protrusion assembly 111 to translate from the locked position 1300 to the unlocked position 1400.

Since the second portion 128 of the slot-protrusion assembly 111 is a part of the latch assembly 138 and is mechanically coupled to the latch member 126, when the second portion 128 of the slot-protrusion assembly 111 is translated toward the proximal end 1302 of the latch assembly 138, the at least one latch spring 124 may be compressed as a result of the translation, causing the latch member 126 to translate from the locked position 500 (as shown in FIG. 5) to the unlocked position 800 (as shown in FIG. 8). In one embodiment, when the handle assembly 136 returns from the second locked configuration 300 (as shown in FIG. 3) to the unlocked configuration 600 (as shown in FIG. 6), the second portion 128 of the slot-protrusion assembly 111 is translated in a direction toward the distal end 1304 of the latch assembly 136, decompressing the at least one latch spring 124, and returning the latch member 126 from the unlocked position 800 (as shown in FIG. 8) to the locked position 500 (as shown in FIG. 5).

Figure 15:
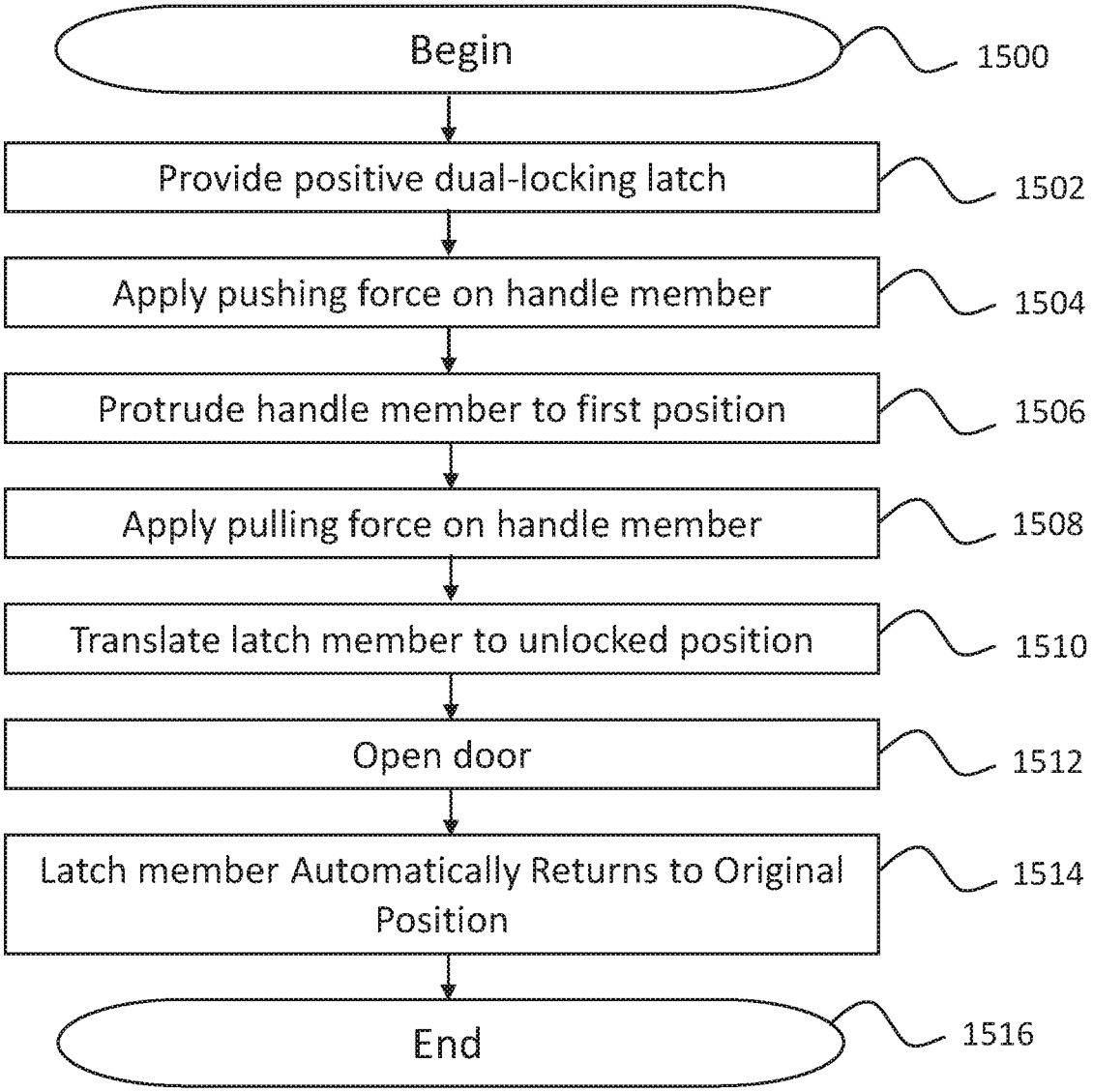
FIG. 15 is a flow chart diagram of a method of using the positive dual-locking latch of FIG. 1 to unlock and open a door, in accordance with the present invention.

FIGS. 1-14 will be described in conjunction with the process flow chart of FIG. 15. Although FIG. 15 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 15 for the sake of brevity. In some embodiments, some or all of the process steps included in FIG. 15 can be combined into a single process.

Referring now to FIG. 15, a method of using the positive dual-locking latch 100 is described in greater detail. The method of using the positive dual-locking latch 100 begins at step 1500 and proceeds directly to step 1502, in which the positive dual-locking latch 100 is provided with the features and configurations described herein above. In one embodiment, the positive dual-locking latch 100 may be provided in the first locked configuration 200, in which the user-accessible knob 206 may be substantially flush with the exterior surface 204 of the door 202.

The method of using the positive dual-locking latch 100 may then proceed to step 1504, which includes applying a pushing force on the user-accessible knob 206, such that the user-accessible knob 206, the handle member 118, and the handle assembly 136 are translated toward the latch base 102 from a position that is substantially flush with the exterior surface 204 of the door 202. In one embodiment, during step 1504, the handle pin 112 may translate from the first aperture 120 to the second aperture 122.

The method of using the positive dual-locking latch may then proceed to step 1506, in which the user-accessible knob 206 may protrude to the first position 400 in the ambient environment surrounding the exterior surface 204 of the door 202. In one embodiment, the positive dual-locking latch 100 may then be in the second locked configuration 300, with the handle spring 114 at least partially decompressed. In the second locked configuration 300, the door 202 may remain locked and unable to be opened by a user.

The method of using the positive dual-locking latch 100 may then proceed to step 1508, which includes applying a pulling force on the user-accessible knob 206, such that the user-accessible knob 206 may be translated away from the latch base 102 to the second position 700 in the ambient environment surrounding the exterior surface 204 of the door 202. In one embodiment, during step 1504, the second portion 128 of the slot-protrusion assembly 111 may be translated toward the proximal end 1302 of the latch assembly 138, the at least one latch spring 124 may be compressed. As such, the method of using the positive dual-locking latch 100 may proceed to step 1510, in which the latch member 126 translates from the locked position 500 to the unlocked position 800. As such, the latch member 126 may disengage from the door frame 208, and the door 202 may be opened in step 1512. At step 1514, upon release of the user-accessible knob 206 by terminating the pulling force applied on the user-accessible knob 206 (e.g. letting it go), the latch member 126 may automatically return to the original locked position 500 from the unlocked position 800. The method may repeat n reverse order to re-lock the door 202, or may end at step 1516.

A positive dual-locking latch and a method of use has been disclosed that overcomes the herein-aforementioned disadvantages of the heretofore-known devices and methods of this general type, and that includes a latch base, a handle assembly housed within and translatable relative to the latch base, and a latch assembly mechanically coupled to the handle assembly. The positive dual-locking latch also includes first locked configuration, a second locked configuration, and an unlocked configuration, wherein the positive dual-locking latch remains locked when the handle member protrudes from an exterior surface of a door in the second locked configuration. As such, the positive dual-locking latch requires a pulling force to be exerted on it in order to translate to the unlocked configuration, thereby disengaging the latch member from the door, unlocking the door, and allowing the door to be opened.

What is claimed is:

1. A positive dual-locking latch for use in combination with a door, the positive dual-locking latch comprising:

a latch base defining a latch opening;

a handle assembly at least partially housed within and translatable relative to the latch base, the handle assembly including:

a proximal end having a housing member, the housing member defining a first portion of a slot-protrusion assembly;

a handle pin mechanically coupled to the housing member;

a handle spring mechanically coupled to the housing member; and a distal end opposite the proximal end, the distal end having a handle member:

at least partially housed within the housing member;

being biased by the handle spring along a handle translation path in a direction away from the latch base;

defining a first aperture sized and shaped to receive the handle pin in a first locked configuration;

defining a second aperture sized and shaped to receive the handle pin in a second locked configuration;

disposed to translate the handle pin between the first aperture in the first locked configuration and the second aperture in the second locked configuration when moved toward the latch base; and disposed to translate the handle assembly from the second locked configuration to an unlocked configuration to unlock the door when moved away from the latch base; and a latch assembly mechanically coupled to the handle assembly, the latch assembly including:

at least one latch spring;

a latch member mechanically coupled to the at least one latch spring; and a second portion of the slot-protrusion assembly sized and shaped to mechanically couple with the first portion of the slot-protrusion assembly.

2. The positive dual-locking latch of claim 1, wherein:

in the first locked configuration:

the handle member is positioned substantially flush with an exterior surface of the door;

the handle spring is compressed; and the handle pin is retained within the first aperture.

3. The positive dual-locking latch of claim 1, wherein:

in the second locked configuration:

the handle member protrudes to a first position in an ambient environment surrounding an exterior surface of the door revealing a user-accessible knob, the user-accessible knob being substantially flush with the exterior surface of the door in the first locked configuration;

the handle spring is at least partially decompressed; and the handle pin is retained within the second aperture.

4. The positive dual-locking latch of claim 3, wherein:

in the unlocked configuration:

the handle member extends to a second position in the ambient environment surrounding the exterior surface of the door, the second position being further from the exterior surface of the door as compared to the first position; and the housing member translates from a locked position to an unlocked position.

5. The positive dual-locking latch of claim 4, wherein:

the unlocked configuration includes:

the slot-protrusion assembly being translated from a locked position to an unlocked position; and as a result of the translation, the at least one latch spring being compressed, so as to cause the latch member to translate from a locked position to an unlocked position.

6. The positive dual-locking latch of claim 1, wherein the handle member further comprises:

a threaded portion; and a user-accessible knob mechanically coupled to the threaded portion.

7. The positive dual-locking latch of claim 1, wherein:

the handle spring is configured to compress and apply a biasing force on the handle member in a direction toward the distal end of the handle assembly; and the handle pin is disposed to lock the handle member in the first locked configuration or the second locked configuration against the biasing force of the handle spring, depending on which of the first aperture and the second aperture the handle pin is retained within.

8. The positive dual-locking latch of claim 1, wherein:

the latch spring is configured to compress and apply a biasing force on the latch member in a direction toward the distal end of the latch assembly to bias the latch member in a locked position.

9. The positive dual-locking latch of claim 8, further comprising:

an arm member mechanically coupled to the at least one latch spring, the arm member operably configured to exert a force from the at least one latch spring to the latch member to bias the latch member in the locked position through the latch opening in the latch base.

10. A positive dual-locking latch for use in combination with a door of a moving vehicle, the positive dual-locking latch comprising:

a latch base defining a latch opening;

a handle assembly at least partially housed within and translatable relative to the latch base, the handle assembly including:

a proximal end having a housing member, the housing member defining a first slot and a second slot, the first slot and the second slot being parallel to each other and on opposite sides of the housing member;

a handle spring mechanically coupled to the housing member;

a distal end opposite the proximal end, the distal end having a handle member:

at least partially housed within the housing member;

biased by the handle spring in a direction away from the latch base;

defining a first aperture corresponding to a first locked configuration; and defining a second aperture corresponding to a second locked configuration and an unlocked configuration, the second aperture positioned between the first aperture and the handle spring; and a push-pull actuator mechanically coupled to the handle member;

a latch assembly mechanically coupled to the handle assembly, the latch assembly including:

a latch member biased by a latch spring in a direction away from the latch base;

a first latch pin sized and shaped to be received by the first slot of the housing member; and a second latch pin sized and shaped to be received by the second slot of the housing member wherein the handle assembly is operably configured to actuate the opening and closing of the latch assembly.

11. The positive dual-locking latch of claim 10, wherein:

the push-pull actuator is operably configured to:

translate the handle assembly from the first locked configuration to the second locked configuration when moved toward the latch base, thereby extending the push-pull actuator to allow a user to grasp the push-pull actuator; and translate the handle assembly from the second locked configuration to the unlocked configuration when moved away from the latch base, thereby unlocking the door.

12. The positive dual-locking latch of claim 11, wherein:

the push-pull actuator is a user-accessible knob.

13. The positive dual-locking latch of claim 11, wherein:

as a result of translating the handle assembly from the second locked configuration to the unlocked configuration, the unlocked configuration includes:

the first latch pin and the second latch pin translating from a locked position to an unlocked position; and the latch spring being compressed by the translation, so as to cause the latch member to translate from a locked position to an unlocked position.

14. The positive dual-locking latch of claim 10, further comprising:

a handle pin mechanically coupled to the housing member, the handle pin operably configured to be received by the first aperture and the second aperture of the push-pull actuator.

15. The positive dual-locking latch of claim 14, wherein:

the handle pin is retained within the first aperture in the first locked configuration.

16. The positive dual-locking latch of claim 14, wherein:

the handle pin is retained within the second aperture in the second locked configuration and the unlocked configuration.

17. The positive dual-locking latch of claim 10, wherein:

in the first locked configuration, the push-pull actuator is positioned substantially flush with an exterior surface of a door.

18. A positive dual-locking latch for use in combination with a door, the positive dual-locking latch comprising:

a latch assembly including:

a latch base operably configured to attach to an interior surface of a door, the latch base defining a substantially vertical plane along the interior surface of the door;

a latch member biased by a latch spring in a direction that is away from and substantially parallel to the substantially vertical plane defined by the latch base, the latch member operably configured to engage with at least a portion of the door;

a handle member biased by a handle spring in a direction that is away from and substantially perpendicular to the substantially vertical plane defined by the latch base, the handle member operably configured to disengage the latch member from the door, wherein the handle spring is coupled to the handle member and is disposed between the handle member and the latch base; and a push-pull actuator mechanically coupled to the handle member;

a first locked configuration of the latch assembly including:

the push-pull actuator being substantially flush with an exterior surface of the door;

and the latch member being engaged with at least a portion of the door;

a second locked configuration of the latch assembly including;

the push-pull actuator being pushed toward the interior surface of the door and subsequently protruding to a first position in an ambient environment surrounding the exterior surface of the door; and the latch member being engaged with at least a portion of the door;

wherein the handle spring is compressed between the handle member and the latch base in the first locked configuration and the second locked configuration; and an unlocked configuration of the latch assembly including:

the push-pull actuator being pulled away from the exterior surface of the door to a second position in the ambient environment surrounding the exterior surface of the door, the second position being further from the exterior surface of the door as compared to the first position; and the latch member being disengaged from the door.

19. The positive dual-locking latch of claim 18, wherein: the latch assembly is stationary in the first locked configuration and the second locked configuration.

20. The positive dual-locking latch of claim 18, wherein: the latch assembly is non-stationary in the unlocked configuration.

* * * * *